United States Patent [19]

Brown

[11] 4,098,400

[45] Jul. 4, 1978

[54] RETURNABLE PACKAGING SYSTEM

[75] Inventor: Frank C. Brown, St. Charles, Mo.

[73] Assignee: Emerson Electric Co., St. Louis, Mo.

[21] Appl. No.: 779,063

[22] Filed: Mar. 18, 1977

[51] Int. Cl.[2] ..... B65D 19/00; B65D 85/68

[52] U.S. Cl. ..... 206/319; 206/386; 206/497; 206/562; 206/593; 206/821; 217/26

[58] Field of Search ..... 206/497, 562, 319, 597, 206/596, 598, 821, 563, 386, 588, 592, 589, 593, 590, 486; 229/3.1; 108/53.1, 55.1, 55.3; 217/26, 26.5, 27

[56] References Cited

U.S. PATENT DOCUMENTS

| | | | |
|---|---|---|---|
| Re. 29,192 | 4/1977 | Anderson et al. | 108/51.3 |
| 2,710,689 | 6/1955 | Prossen | 217/26 |
| 3,085,731 | 4/1963 | Wilkins | 229/3.1 |
| 3,137,388 | 6/1964 | Strouth | 206/597 |
| 3,285,412 | 11/1966 | Knight et al. | 206/486 |
| 3,670,880 | 6/1972 | Burleson et al. | 206/497 |
| 3,825,113 | 7/1974 | Kramer et al. | 206/497 |
| 3,853,217 | 12/1974 | Scordato et al. | 206/562 |
| 3,904,030 | 9/1975 | Repp et al. | 206/821 |
| 3,944,070 | 3/1976 | Cardwell et al. | 206/497 |
| 3,949,927 | 4/1976 | Smith et al. | 229/3.1 |
| 3,961,707 | 6/1976 | Lehr et al. | 206/497 |
| 3,962,469 | 6/1976 | Leavens et al. | 206/497 |

*Primary Examiner*—William Price
*Assistant Examiner*—Joseph M. Moy
*Attorney, Agent, or Firm*—Polster, Polster and Lucchesi

[57] ABSTRACT

A returnable packaging system provides product protection in a simplified, low cost design. The packaging system includes a conventional pallet structure having an upper surface covered by a protective sheet. A plurality of parts are layered between a plurality of trays, the trays being identical to one another. The trays preferably generally are planar, being constructed from relatively thin sheets having receptacles formed on opposed sides of the sheets. The receptacles have a silhouette designed to receive a portion of the parts carried by the trays. The bottom tray of a second part layer serves as the cover for a first part layer so that an interlocked structure results which prevents horizontal movement of the individual parts. The layered assembly is encapsulated in a heat shrinkable cover. When shrunk, the cover holds the entire system in a stable integral package condition. The cover is removed when the parts are used.

7 Claims, 7 Drawing Figures

RETURNABLE PACKAGING SYSTEM

BACKGROUND OF THE INVENTION

This invention relates to packaging systems and in particular, to a material handling system for the shipment and storage of high volume products or components. The invention is described in detail with respect to dynamoelectric machines, but those skilled in the art will recognize the wider applicability of the invention disclosed hereinafter.

Dynamoelectric machines, for example, induction motor of various forms often are manufactured for sale to original equipment manufacturers who employ the motors in their own particular products. It has been common in the motor industry to ship electric motors in conventional, corrugated paperboard packages. While these packages work well for their intended purposes, they exhibit a number of inherent deficiencies. Thus, the paperboard packages tend to absorb moisture over a period of time. Desiccants, commonly added to the paper packages, do protect the metallic motors in the packages for relatively short periods of time. However, desiccants generally used for this purpose become ineffective over longer time periods and prolonged storage of electric motors in paperboard containers often results in rusted parts. All of the conventional paperboard package components, in addition to the desiccant containers, require disposal after use, generating a considerable waste removal problem for the original equipment manufacturer. Finally, it is not uncommon to have the motors shift during transit, requiring relatively costly retesting and replacement of damaged parts.

A number of solutions to the waste disposal, environmental effect on motor parts, and container designs for shipping damage prevention have been proposed. One packaging system particularly useful in protecting hermetic motor parts is disclosed in U.S. Pat. No. to Repp and Brown, No. 3,904,030. While the system of that patent works well, it represents a comparatively high cost design. Such a system is justified with hermetic motor parts because of the high environmental purity which must be maintained with hermetic motor parts. Large volume motors finding applications, for example, in washing machines, dryers and other such consumer appliances, however, do not require the high degree of protection against environmental conditions required for hermetic motors, although some such protection is desirable. In addition, these motors generally are lower cost, and the high cost packaging system, although returnable, is disproportionate to the selling price of the motors over the useful life of the packaging system.

The invention disclosed hereinafter overcomes these prior art difficulties by providing a low cost, simply designed packaging system, the major components of which are returnable to the initial supplier. While some waste material is associated with the system, it is a minor disposal problem in comparison to conventional corrugated packaging systems discussed above. In addition, those components of the packaging system returnable to the initial manufacturer represent a small volume of the total fully loaded packaging system. Volume reduction is accomplished primarily through the use of relatively thin trays having generally planar opposed surfaces. The surfaces, in turn, have a predetermined number of receptacles formed in them. The receptacles along the bottom side of the tray receives the top of a first layer plurality of parts, while the receptacle along the top side of the tray receives the bottom of the succeeding layer.

One of the objects of this invention is to provide a returnable packaging system.

Another object of this invention is to provide a returnable packaging system having a simple design and low cost.

Still another object of this invention is to provide a packaging system having a reduced size when empty.

Yet another object of this invention is to provide a packaging system providing environmental protection for the packaged parts.

Other objects of this invention will be apparent to those skilled in the art in light of the following description and accompanying drawings.

SUMMARY OF THE INVENTION

In accordance with this invention, generally stated, a packaging system includes a product package having a plurality of individual but similar trays which are arranged in stacked relationship between layers of individual parts. The stacked layers of parts are held against shifting by receptacles in the trays and the entire stack of trays and parts is enveloped in a heat shrinkable cover. Each of the trays has essentially flat, oppositely opposed faces having a plurality of cut-outs or receptacles formed in them. Preferably, the cut-outs extend from and through the opposed faces and are sized to receive a top of a first part and a bottom of a second part in the part stack. The cut-outs are designed so that the top and bottom of the respective parts are separated from one another. The parts and trays are assembled on a conventional pallet in stacked relationship, and the part stack is sealed by bringing the heat shrinkable film about the part stack and sealing it to the pallet. After use, the pallets and trays are returnable as a unit having a much smaller size than the loaded condition of the part stack.

DESCRIPTION OF THE PREFERRED EMBODIMENT

Figure 1:
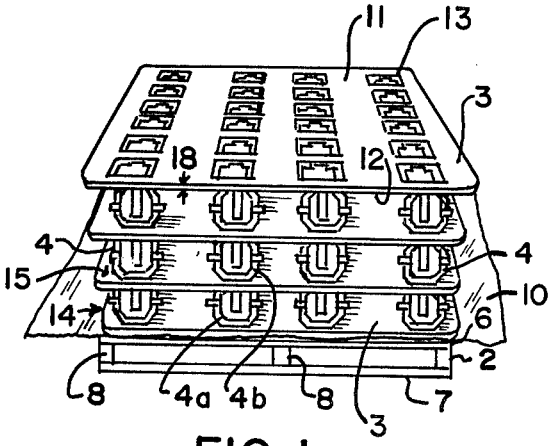
FIG. 1 is a view in perspective of one illustrative embodiment of packaging system of this invention, shown in a partly loaded condition.
Figure 2:
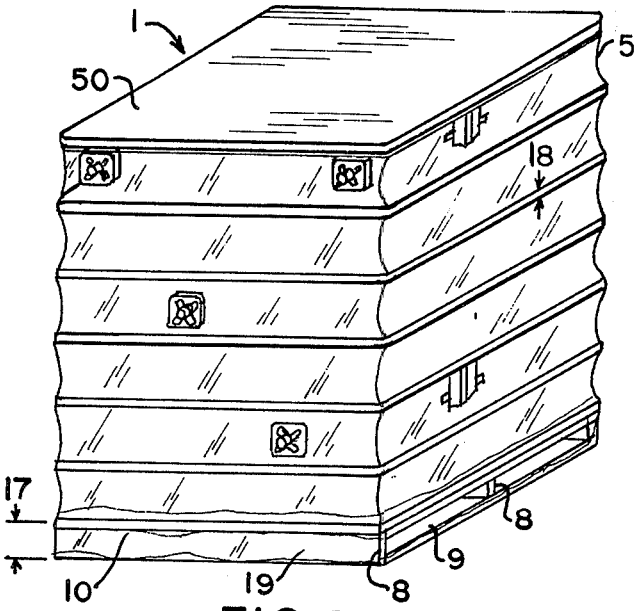
FIG. 2 is a view perspective of the packaging system of FIG. 1 shown in its fully loaded condition.

Referred now to FIGS. 1 and 2, reference numeral 1 indicates a returnable packaging system formed by a shipping package 50 including a pallet 2, a predetermined number of trays 3 for holding a plurality of parts 4, and a heat shrinkable cover 5.

The pallet 2 is conventional and is not described in detail. It generally includes an upper surface 6, a bottom 7 and a plurality of supports 8 arranged to define at least one passage 9. The passage 9 is sized to receive the lifting mechanism of a conventional fork lift truck, for example, to permit easy transfer of the packaging system 1.

Preferably, a layer of plastic film material 10 is placed over the surface 6 of the pallet 2, and a first one of a plurality of the trays 3 is placed on the plastic film. The plastic film 10 helps prevent environmental conditions from affecting the parts 4 by closing off the pallet surface 6 from that portion of the system 1 in which the parts 4 are carried. Where prolonged storage is not contemplated, or environmental conditions are not a factor, the film 10 may be eliminated from use in the system 1. The film 10 may and preferably is a material similar to that used for the cover 5, later described in more detail.

Each of the trays 3 in a particular one of the shipping packages 50 is identical and preferably is of a relatively thin, planar design having a first surface 11, a second surface 12 and a material thickness 18. Commonly, I have found a thickness of one inch or less suitable for use with the trays 3. The surfaces 11 and 12 are oppositely opposed to one another, and each tray 3 has a plurality of cut-outs or receptacles 13 formed in it. Preferably, the cut-outs 13 extend between and through the surfaces 11 and 12. However, as later described, other tray embodiments compatible with the packaging system 1 may not require either use of a preformed receptacle or require any opening between or through the surfaces 11 and 12.

Figure 3:
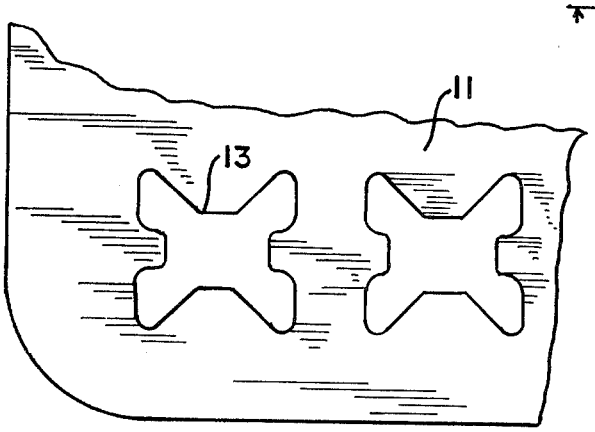
FIG. 3 is a top plan view, partly broken away, of one illustrative embodiment of a tray compatible with the packaging system of this invention.
Figure 4:
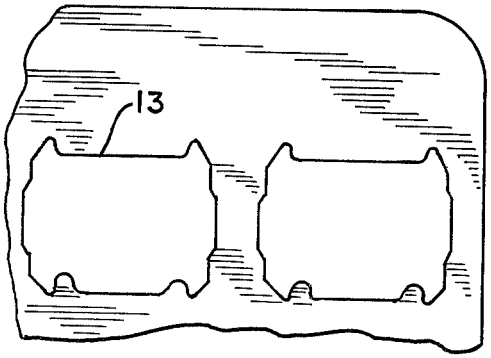
FIG. 4 is a top plan view, partly broken away, of a second illustrative tray embodiment.
Figure 5:
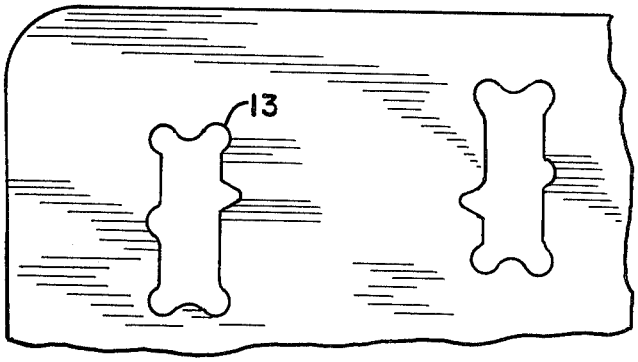
FIG. 5 is a top plan view, partly broken away, of a third illustrative tray embodiment.

The cut-outs 13 may assume a variety of shapes, illustrative ones being shown in FIGS. 3, 4 and 5. The cut-outs 13 of FIG. 3 may be used for motors finding application in conventional dishwashers, while the outline of the receptacles 13 shown in FIG. 4 may receive a motor used in a clothes dryer application, for example, while still another motor design may require the outline illustrated in FIG. 5. The cut-outs 13 are sized so that individual ones of the part plurality 4 nest in the cut-outs. That is to say, the top of a part 4*a* of a layer 14 and the bottom of a part 4*b* of a layer 15 both are received in an individual cut-out 13 of a particular tray 3. The cut-outs, while receiving the parts 4, are designed to prevent intimate contact between the parts 4*a* and 4*b*. The nesting provided by the cut-outs 13 merely prevents shifting of the individual parts after placement of these parts within the cut-outs.

Various ones of the layers 14 and 15 are successively stacked upon one another, until a predetermined package height is obtained. I find it convenient to use approximately six layers of parts for each package 50, commencing with a tray 3, ending with a tray 3, and separating each layer with a tray 3. After tray 3 and part 4 placement, the cover 5 is placed about the stack of parts. Cover 5 preferably is a heat shrinkable closure having at least one open mouth for receiving the stacked parts. The cover is placed over or about the layered arrangement of parts 4 so that an end 19 of the cover 5 circumscribes the pallet 2 along a height dimension 17 of the pallet. When so positioned, the plastic film material 10 will abut the cover 5 along the perimetrical edge of the surface 6 of the pallet 2. Thereafter, the cover 5 is heat shrunk to tightly enclose the package 50. Shrinking the cover 5 locks the layered trays 3 and parts 4 against one another and against the pallet 2, resulting in an exceeding stable packaging system. Heat shrinking may be accomplished by any convenient method. Passage through a conventional heat shrink tunnel, or various hand held and hand operated shrinking devices may be used for that purpose, for example. Heat shrinking of the cover 5 also adheres the end 19 of the cover 5 to the pallet 2 and tends to join the plastic film material 10 to the cover 5, giving the shipping package 50 complete environmental protection. After shrink, the cover 5 closes the passages 9 in the pallet 2.

The trays 3 shown in FIGS. 1 through 5 are constructed from a single material. However, they may have a laminated construction, if desired. For example, the outer surfaces 11 and 12 of the trays may be formed from a relatively stiff material, that permits easy manufacture of the receptacles 13, while a middle portion of the tray is constructed from "Styrofoam" material.

Figure 6:
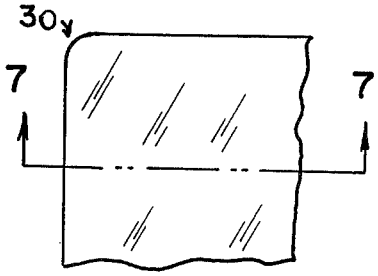
FIG. 6 is a top plan view, partly broken away, of a fourth illustrative tray embodiment.
Figure 7:
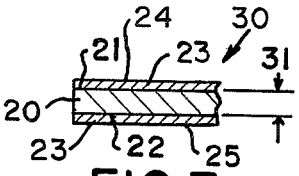
FIG. 7 is a sectional view, partly broken away, taken along the line 7—7 of FIG. 6.

In the alternative, the trays 3 may be constructed in a reversed layer structure, and one such embodiment is shown in FIGS. 6 and 7. As there illustrated, a tray 30 has a base 20 formed of relatively rigid or stiff material. The base 20 has first and second opposed planar surfaces 21 and 22, and a thickness 31. Each of the surfaces 21 and 22 has a layer of relatively soft material 23 attached to it. The material 23 preferably is an expanded foam or polystyrene material, or it again may comprise a material available commercially under the trademark "Styrofoam". In any case, the material should be one that may be compressed by the application of a relatively light force. The tray 30 shown in FIGS. 6 and 7, initially has a completely unbroken, planar outer boundary 24 and 25 on respective outboard surfaces 21 and 22 of the tray. The trays 30 are used in the same manner as the trays 3, described above, except that the parts 4 merely are placed on or against the boundaries 24 and 25. The weight of the parts 4 in the stacked relationship shown in FIGS. 1 and 2 is sufficient to cause indentations in the material 23 which permits the parts 4 to nest in a manner similar to that previously described. The self nesting action is sufficient to prevent part movement of the motor parts application in conjunction with which the preferred embodiment is described. It is apparent that printed markings may be used on the boundaries 24 and 25 to indicate proper part placement.

As thus shown and described, a simple, low cost packaging system is provided meeting all the ends and objects herein set forth above.

Numerous variations, within the scope of the appended claims, will be apparent to those skilled in the art in light of the foregoing description and accompanying drawings. Thus, the design silhouette of the pallets and trays may vary in other embodiments of this invention. While I find it convenient to utilize a conventional pallet, more esoteric pallet designs are compatible with the broader aspects of this invention. For example, the pallet has a closed upper surface which will provide environmental integrity to the package 50 without the use of the film 10. Likewise, tray 3 design may vary in both its overall design silhouette and in the design silhouette of the cut-outs 13. Although various materials were described as preferred, other materials may be substituted for those set out. Additional structure may be employed with the shipping package 50. For example, in some applications, conventional shipping bands may be employed about the shipping package 50. For the application described, however, I have found the use of shipping bands unnecessary. These variations are merely illustrative.

Having thus described the invention, what is claimed and desired to be secured by Letters Patent is:

1. A returnable packaging system, comprising:

a pallet;

a plurality of trays on said pallet, said trays being constructed from a relatively thin thickness of material, said trays having a first generally planar outer surface and a second generally planar outer surface, with the material thickness of said trays therebetween and means along said outer surfaces of said trays for receiving a plurality of parts, said receiving means including a plurality of receptacle cut-outs extending inwardly of said first and second planar surfaces through said thickness, each cut-out being seized to nest each individual parts therein and to receive parts on opposite sides of said trays, whereby said cut-outs being designed to prevent intimate contact between each part on opposite sides of said trays and whereby the nesting provided by said cut-outs prevents shifting of each individual parts;

said plurality of parts on said trays being arranged in a tray-part-tray layer relationship, the top of a part of a first layer being spaced from a bottom of a part of a succeeding layer in said layered relationship by individual ones of said tray plurality; and a heat shrinkable cover about layered parts, said cover engaging at least a portion of said pallet below the initial tray of said stacked plurality of parts in the heat shrunk size thereof.

2. The packaging system of claim 1 wherein said trays are constructed from a paperboard material.

3. The packaging system of claim 1 wherein said pallet has at least one channel formed in it, sized to permit reception of a lifting mechanism, said heat shrinkable cover closing the mouth of said channel in the initial heat shrink size of said cover.

4. The packaging system of claim 1 further including a cover sheet along said pallet, between said pallet and a first tray of said layered stack of parts, said cover sheet abutting the heat shrinkable cover in the heat shrink size of said cover.

5. The packaging system of claim 5 wherein said outer surfaces of said trays comprise a layer of deformable material.

6. The packaging system of claim 1 wherein said tray is constructed from a corrugated material.

7. The packaging system of claim 1 wherein said tray has a laminated construction, said tray having a relatively flexible material integrated between opposed sheets of a corrugated material.

* * * * *

UNITED STATES PATENT AND TRADEMARK OFFICE

CERTIFICATE OF CORRECTION

PATENT NO. : 4,098,400

DATED : July 4, 1978

INVENTOR(S) : Frank C. Brown

It is certified that error appears in the above-identified patent and that said Letters Patent are hereby corrected as shown below:

Column 1, line 23 delete "paper" and insert --- paperboard ---.

Column 3, line 47 delete "these" and insert --- those ---.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*